US009034148B2

(12) United States Patent
Nagoshi et al.

(10) Patent No.: US 9,034,148 B2
(45) Date of Patent: May 19, 2015

(54) METHOD FOR PRODUCING ELECTRICALLY-CONDUCTING MATERIAL WITH MODIFIED SURFACE

(75) Inventors: Masayasu Nagoshi, Chiba (JP); Kaoru Sato, Chiba (JP); Seiichi Watanabe, Hokkaido (JP); Souki Yoshida, Hokkaido (JP)

(73) Assignee: JFE STEEL CORPORATION, Tokyo (JP)

( * ) Notice: Subject to any disclaimer, the term of this patent is extended or adjusted under 35 U.S.C. 154(b) by 212 days.

(21) Appl. No.: 13/819,121

(22) PCT Filed: Aug. 26, 2011

(86) PCT No.: PCT/JP2011/069974

§ 371 (c)(1),
(2), (4) Date: May 8, 2013

(87) PCT Pub. No.: WO2012/026624

PCT Pub. Date: Mar. 1, 2012

(65) Prior Publication Data

US 2014/0144782 A1 May 29, 2014

(30) Foreign Application Priority Data

Aug. 26, 2010 (JP) ..... 2010-189962

(51) Int. Cl.

| | |
|---|---|
| ***C25D 5/10*** | (2006.01) |
| ***C25D 5/16*** | (2006.01) |
| ***C23C 26/00*** | (2006.01) |
| ***C25F 1/00*** | (2006.01) |
| ***C25F 3/00*** | (2006.01) |

(52) U.S. Cl.
CPC . *C25D 5/16* (2013.01); *C23C 26/00* (2013.01); *C25F 1/00* (2013.01); *C25F 3/00* (2013.01)

(58) Field of Classification Search
CPC ..... C23C 26/00; C25D 5/16; C25F 3/00; C25F 1/00; B01J 19/088; B01J 2219/0894; B01D 53/32
USPC ..... 204/164
See application file for complete search history.

(56) References Cited

U.S. PATENT DOCUMENTS

| | | | | |
|---|---|---|---|---|
| 2008/0190770 | A1* | 8/2008 | Daigle et al. | 204/554 |
| 2010/0089759 | A1 | 4/2010 | Watanabe et al. | |
| 2011/0229656 | A1 | 9/2011 | Shibata et al. | |

FOREIGN PATENT DOCUMENTS

| | | |
|---|---|---|
| JP | 2009-235559 | 10/2009 |
| JP | 2010-070782 | 4/2010 |
| WO | WO 2008/099618 | 8/2008 |

OTHER PUBLICATIONS

International Search Report, PCT/JP2011/069974, Oct. 11, 2011.

*Primary Examiner* — Xiuyu Tai
(74) *Attorney, Agent, or Firm* — Young & Thompson

(57) ABSTRACT

A method to inexpensively and efficiently produce conductive materials on the surface of which a nano-level fine structure is formed includes surface modification including immersing a stable anode electrode and a workpiece as a cathode electrode, the workpiece including a conductive material with a work surface, in an electrolytic solution, then applying a voltage not less than a first voltage and less than a second voltage between the stable anode electrode and the workpiece as the cathode electrode immersed in the electrolytic solution, thereby modifying the work surface, the first voltage being a voltage corresponding to a current value that is ½ of the sum of a first maximum current value appearing first in a positive voltage region and a first minimum current value appearing first in the positive voltage region with respect to voltage-current characteristics of a surface modification treatment system, the second voltage exhibiting a complete-state plasma.

12 Claims, 10 Drawing Sheets

(a)

(b)

(a)

(b)

METHOD FOR PRODUCING ELECTRICALLY-CONDUCTING MATERIAL WITH MODIFIED SURFACE

TECHNICAL FIELD

The present invention relates to a method for producing electrically-conducting materials with modified surface. In particular, the invention relates to a method for producing conductive materials on the surface of which a nano-level fine structure is formed.

BACKGROUND ART

In the field of conductive materials including metal sheets such as steel sheets, attentions have been recently drawn to high functional (high-value-added) materials that have been given various functions on the surface. A particularly attractive method of imparting functions to the surface of conductive materials is to form a fine structure on the order of micrometers or less (nano level) on the material surface so as to give any of various functions on the surface of materials.

With regard to the formation of nano-level fine structures on material surfaces, a method has been studied in which a nanometer-sized fine structure is formed on the surface of a substrate or the like by a photolithographic method or a chemical vapor deposition (CVD) method (for example, see Non Patent Literature 1). However, the formation of a nano-level fine structure by photolithography or chemical vapor deposition entails advanced techniques and expensive devices. Thus, these methods do not allow low-cost and efficient formation of nano-level fine structures.

On the other hand, methods involving submerged electric discharge have been recently proposed for the purpose of forming nanometer-sized fine particles at low cost and efficiently, cleaning a conductive surface, or coating (metalizing) a conductive surface after the surface is cleaned (see, for example, Patent Literatures 1 to 3).

In detail, Patent Literature 1 proposes a method in which a high voltage is applied between a cathode and an anode placed in an electrolytic solution so as to generate plasma by glow discharge in the vicinity of the cathode (hereinafter, referred to as "submerged plasma"), thereby locally fusing the cathode material to form conductive fine particles (nanoparticles) of the cathode material in the solution. In order to form finer particles by submerged plasma discharge, Patent Literature 1 adopts the application of such a voltage that exhibits a complete-state plasma in which the plasma emits light from the entire surface of electrode (for example, a voltage as high as 140 to 300 V, although variable in accordance with, for example, the type of cathode material used).

Patent Literatures 2 and 3 propose methods which include providing a workpiece as a cathode and an anode that has one or more apertures, causing an electrolyte to flow through the apertures in the anode and impinge on the surface of the workpiece, and applying a predetermined voltage between the workpiece (cathode) and the anode so as to clean the surface of the workpiece or further to form a coating on the surface of the workpiece after cleaning. According to Patent Literatures 2 and 3, the surface roughness of the cleaned workpiece is so increased as to achieve high adhesion with respect to a coating film.

However, the techniques disclosed in Patent Literatures 1 to 3 are dedicated to the production of nanoparticles from a cathode material, or to cleaning or coating of the surface of a workpiece. That is, they do not have any technical idea of forming a nano-level fine structure on the surface of a cathode material. Moreover, the fact that electric discharge is performed under conditions which increase the surface roughness of a cathode material (a workpiece) eliminates the possibility for the methods to be used for the formation of a nano-level fine structure on the surface of the cathode material itself.

CITATION LIST

Patent Literature

[PTL 1] International Publication No. 2008/099618

[PTL 2] Japanese Unexamined Patent Application Publication (Translation of PCT Application) No. 2001-508122

[PTL 3] Japanese Unexamined Patent Application Publication (Translation of PCT Application) No. 2001-501674

Non Patent Literature

[NPL 1] Motoichi Ohtsu, "Nanomaterial Saizensen (Frontiers of Nanomaterials)", Kagaku-Dojin Publishing Co., Inc., 2002, p. 52

SUMMARY OF INVENTION

Technical Problem

It is therefore an object of the invention to provide a method capable of inexpensively and efficiently producing conductive materials on the surface of which a nano-level fine structure is formed.

Solution to Problem

In order to produce conductive materials on the surface of which a nano-level fine structure is formed at low cost and efficiently, the present inventors studied possibilities including the applicability of submerged plasma discharge which has been thought to be incapable of forming nano-level fine structures. As a result, the present inventors have found that a nano-level fine structure can be formed on the surface of a workpiece (a cathode electrode) by generating local submerged plasma discharge at a predetermined voltage with the workpiece being used as a cathode electrode. The present invention has been completed based on the finding.

That is, the present invention aims to solve the aforementioned problems in an advantageous manner. A method for producing electrically-conducting materials with modified surface according to the invention includes a surface modification treatment step which includes immersing a stable anode electrode and a workpiece as a cathode electrode, the workpiece including a conductive material with a work surface, in an electrolytic solution and thereafter applying a voltage that is not less than a first voltage and less than a second voltage between the stable anode electrode and the workpiece as the cathode electrode immersed in the electrolytic solution, thereby modifying the work surface, the first voltage being a voltage corresponding to a current value that is ½ of the sum of a first maximum current value that appears first in a positive voltage region of the and a first minimum current value that appears first in the positive voltage region of the maximum current with respect to voltage-current characteristics of a surface modification treatment system (that is, an intermediate value between the first maximum current value and the first minimum current value), the second voltage being a voltage that exhibits a complete-state plasma.

In the present invention, the term "electrolytic solution" refers to an electrolytic solution which has electrical conductivity, exhibits a higher ionization tendency than the workpiece, and is such that the solution does not substantially inhibit desired modification treatment for the work surface (namely, the formation of a nano-level fine structure) by excessively etching the work surface or due to components in the solution being precipitated or deposited on the work surface during the modification treatment for the work surface. By the way, the electrolytic solution may contain metal ions as long as such metal ions do not inhibit the formation of a nano-level fine structure by being precipitated on the surface of the cathode electrode during the modification treatment (electrolysis).

The term "stable anode electrode" refers to an electrode formed of a conductive material that is not easily ionized in the electrolytic solution when the work surface is modified.

The term "surface modification treatment system" refers to a system which includes the stable anode electrode, the cathode electrode (the workpiece) and the electrolytic solution and in which the workpiece is surface-modified. The "voltage-current characteristics of the surface modification treatment system" can be obtained by measuring changes in current value when the voltage applied between the stable anode electrode and the cathode electrode immersed in the electrolytic solution is continuously altered.

Regarding the voltage-current characteristics of the surface modification treatment system in the present invention, increasing the applied voltage (positive voltage) is accompanied by a current value being increased to a maximum value and then decreased, and thereafter being increased again or staying constant. In the invention, this maximum value reached when the applied voltage is being increased (the maximum value appearing first in a positive voltage region) is referred to as the "first maximum current value". The "first minimum current value" is defined as a minimum value reached before the current being decreased starts to be increased (the minimum value appearing first in the positive voltage region) or a value at which the current stays constant.

The term "complete-state plasma" refers to a state in which an orange-mixed light or an orange-based light is emitted during discharge so as to cover the surface of the cathode electrode. The phrase "voltage giving rise to a complete-state plasma" can be defined as a voltage whose application for 30 minutes oxidizes a superficial layer of the cathode electrode with a thickness of at least 100 nm in the case of iron and steel materials including carbon steels and alloy steels, and materials that are oxidized at high temperature by atmospheric heating such as stainless steel, zinc and aluminum. The thickness of the superficial oxide layer of the cathode electrode can be determined by observing a cross section of the cathode electrode with SEM and measuring the average thickness of the oxide layer. Here, the oxide layer can be clearly distinguished from the back-scattered electron images observed by SEM. The average thickness of the oxide layer can be evaluated by determining the average of thicknesses of the oxide layer measured with respect to a 10 μm long cross section parallel to the surface of the cathode electrode. In the case where the superficial layer of the cathode electrode contains voids or the like, the oxide thickness includes such voids.

In the inventive method for producing electrically-conducting materials with modified surface, it is preferable that a voltage of not less than 60 V and less than 140 V be applied between the stable anode electrode and the cathode electrode. When the applied voltage is not less than 60 V, the work surface can be sufficiently modified by the formation of a nano-level fine structure. When the applied voltage is less than 140 V, the generation of complete-state plasma can be sufficiently suppressed so as to prevent the formation of a nano-level fine structure on the work surface from being failed by the oxidation of the workpiece.

In the inventive method for producing electrically-conducting materials with modified surface, it is preferable that the conductive material be a metal or an alloy. Metal and alloy are particularly suited as the conductive materials to be surface-modified by the method of the invention because they are relatively inexpensive compared to semiconductor materials or the like and are easily workable and shapeable among conductive materials.

In the inventive method for producing electrically-conducting materials with modified surface, it is preferable that the conductive material be a carbon-containing steel material (hereinafter, referred to as "carbon steel"). Carbon steels are particularly suited as the conductive materials to be surface-modified by the method of the invention because they are relatively inexpensive compared to semiconductor materials and are easily workable and shapeable among conductive materials.

In the inventive method for producing electrically-conducting materials with modified surface, it is preferable that the conductive material be a stainless steel. Stainless steels are particularly suited as the conductive materials to be surface-modified by the method of the invention because they are relatively inexpensive compared to semiconductor materials, are easily workable and shapeable among conductive materials, and have high corrosion resistance.

In the inventive method for producing electrically-conducting materials with modified surface, the electrolytic solution is an aqueous solution containing at least one selected from the group consisted of the followings: potassium carbonate, sodium carbonate, sodium hydrogencarbonate and ammonium carbonate, lithium hydroxide, sodium hydroxide, magnesium hydroxide, potassium hydroxide and ammonium hydroxide, sodium chloride, potassium chloride, magnesium chloride and ammonium chloride; sulfates of elements such as lithium, sodium, magnesium, potassium and ammonium; nitrates of elements such as lithium, sodium, magnesium, potassium and ammonium; citrates of elements such as lithium, sodium, magnesium, potassium and ammonium; and sulfuric acid, nitric acid, hydrochloric acid and citric acid. This feature is adopted because aqueous solutions of potassium carbonate, sodium carbonate, sodium hydrogencarbonate, ammonium carbonate, lithium hydroxide, sodium hydroxide, magnesium hydroxide, potassium hydroxide and ammonium hydroxide, sodium chloride, potassium chloride, magnesium chloride, ammonium chloride; sulfates of elements such as lithium, sodium, magnesium, potassium and ammonium; nitrates of elements such as lithium, sodium, magnesium, potassium and ammonium; citrates of elements such as lithium, sodium, magnesium, potassium and ammonium; and sulfuric acid, nitric acid, hydrochloric acid and citric acid are particularly suited as electrolytic solutions.

Advantageous Effects of Invention

According to the present invention, conductive materials on the surface of which a nano-level fine structure is formed can be produced at low cost and efficiently.

DESCRIPTION OF EMBODIMENTS

Hereinbelow, embodiments of the present invention will be described in detail with reference to the drawings. A method for producing electrically-conducting materials with modified surface according to the invention is characterized in that an stable anode electrode and a workpiece as a cathode electrode which is formed of a conductive material are immersed in an electrolytic solution and thereafter a predetermined voltage is applied between the stable anode electrode and the cathode electrode (the workpiece formed of a conductive material) so as to form a nano-level fine structure on the surface (the work surface) of the workpiece, thereby producing a surface-modified conductive material.

Figure 1:
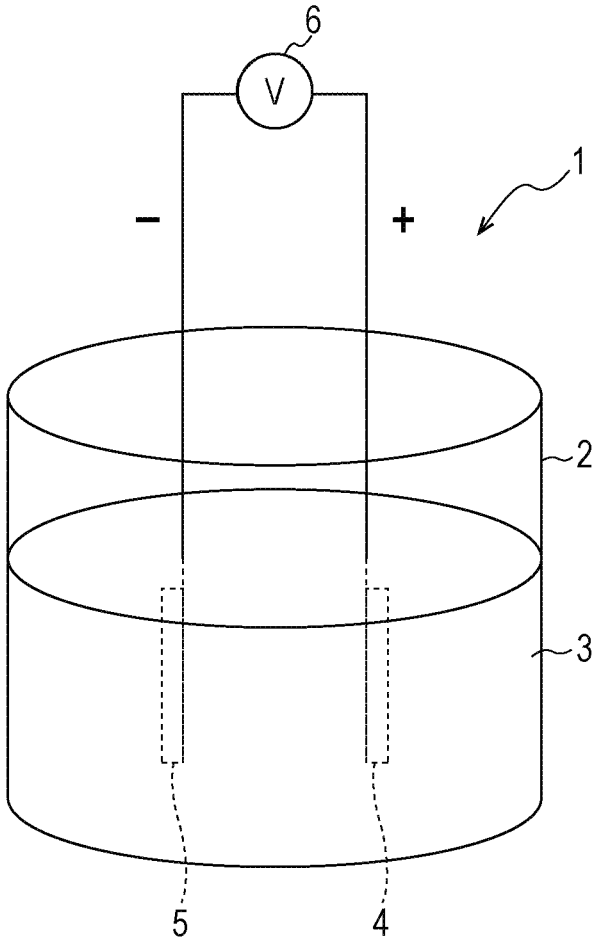
FIG. 1 is an illustration of a configuration of an exemplary surface modification device used in the production of conductive materials by a representative method for producing electrically-conducting materials with modified surface according to the invention.

Although not particularly limited thereto, an example of the inventive method for producing electrically-conducting materials with modified surface may be carried out using, for example, a surface modification device 1 illustrated in FIG. 1.

The surface modification device 1 shown in FIG. 1 is provided with a modification treatment cell 2, an electrolytic solution 3 reserved in the modification treatment cell 2, an anode electrode 4 and a cathode electrode 5 immersed separately from each other in the electrolytic solution 3 wherein the cathode electrode is formed of a conductive workpiece, and a direct-current power source 6 connected to these anode electrode 4 and cathode electrode 5. The liquid surface of the electrolytic solution 3 in the modification treatment cell 2 may be optionally covered with a heat resistant resin (not shown). The surface modification device 1 may be provided with heating means such as a heater (not shown) in order to heat the electrolytic solution 3.

Here, the modification treatment cell 2 may be any of known cells formed of materials that are stable to the electrolytic solution 3, for example glass cells, Teflon (registered trademark) cells or polyethyl ether ketone (PEEK) cells.

The electrolytic solution 3 is a solution that has electrical conductivity, exhibits a higher ionization tendency than the workpiece as the cathode electrode 5, and is unlikely to excessively etch the work surface as well as unlikely to become attached or precipitated to or form deposits on the surfaces of the anode electrode 4 and the cathode electrode 5 during the formation of a nano-level fine structure on the work surface (the surface of the cathode electrode 5) under the application of a voltage between the anode electrode 4 and the cathode electrode 5 (the workpiece). For example, the electrolytic solution 3 may be an aqueous solution including at least one selected from the group consisting of potassium carbonate ($K_2CO_3$), sodium carbonate ($Na_2CO_3$), sodium hydrogencarbonate ($NaHCO_3$), ammonium carbonate ($(NH_4)_2CO_3$), lithium hydroxide (LiOH), sodium hydroxide (NaOH), magnesium hydroxide ($Mg(OH)_2$), potassium hydroxide (KOH), ammonium hydroxide ($NH_4OH$), sodium chloride (NaCl), potassium chloride (KCl), magnesium chloride ($MgCl_2$), ammonium chloride ($NH_4Cl$), sulfates of lithium, sulfates of sodium, sulfates of magnesium, sulfates of potassium, sulfates of ammonium, nitrates of lithium, nitrates of sodium, nitrates of magnesium, nitrates of potassium, nitrates of ammonium, citrates of lithium, citrates of sodium such as sodium citrate ($NaH_2(C_3H_5O(COO)_3)$ citrates of magnesium, citrates of potassium, citrates of ammonium, sulfuric acid, nitric acid, hydrochloric acid and citric acid.

The electrolytic solution 3 may have any pH and any concentration as long as the surface modification of conductive materials as workpieces is feasible. For example, in the case where the electrolytic solution 3 is an aqueous potassium carbonate solution, the concentration thereof may be not less than 0.001 mol/L, and more preferably not less than 0.005 mol/L without limitation. The concentration may be as described above because an excessively low concentration can cause difficulties in maintaining a suitable discharge during the application of a voltage between the anode electrode 4 and the cathode electrode 5. The upper limit of the concentration is not particularly specified, but may be, for example, 0.5 mol/L or less. The pH of the electrolytic solution 3 may be any value as long as excessive corrosion or etching of the electrodes is avoided. For example, the pH may be 5 to 12.

When it is desired that a discharge be prevented from occurring at the liquid surface of the electrolytic solution 3 during the application of a voltage between the anode electrode 4 and the cathode electrode 5, the liquid surface of the electrolytic solution 3 in the modification treatment cell 2 may be covered with a heat resistant resin such as a heat-shrinkable fluororesin tube.

The anode electrode 4 is an stable anode electrode formed of an electrode material which does not inhibit the formation of a nano-level fine structure by being ionized and dissolved into the electrolytic solution 3 so as to be precipitated on the cathode electrode 5 during the formation of a nano-level fine structure on the work surface (the surface of the cathode electrode 5) under the application of a voltage between the anode electrode 4 and the cathode electrode 5 (the workpiece). For example, the anode electrode 4 may be a platinum (Pt) electrode, a palladium (Pd) electrode, an iridium (Ir) electrode, or their alloys, an electrode with the surface coated with Pt, Pd or Ir, or their alloys, or a graphite electrode.

The cathode electrode 5 is a workpiece whose surface is subjected to a modification treatment by the application of a voltage. This electrode is formed of a material having conductivity (a conductive material) such as a metal or an alloy. Here, examples of the workpieces (the conductive materials) functioning as the cathode electrode 5 include carbon steels, alloy steels, stainless steels and nickel materials. The shape of the cathode electrode 5 (the workpiece) is not particularly limited and may be any of sheet shapes, thread (wire) shapes and rectangular shapes. The workpiece (the conductive material) may be optionally used as the cathode electrode 5 after being specular polished on the surface with sand paper or the like.

The direct-current power source 6 applies a voltage required for the surface modification treatment for the cathode electrode 5 as the workpiece, for example, a voltage of not less than 60 V and less than 140 V between the anode electrode 4 and the cathode electrode 5. The direct-current power source 6 may be any of known power sources.

With the surface modification device 1 having the above configuration, a surface-modified conductive material may be produced according to the inventive method for producing electrically-conducting materials with modified surface, for example as described below.

First, the anode electrode 4 that is an stable anode electrode and the cathode electrode 5 that is a workpiece formed of a conductive material are immersed separately from each other in the electrolytic solution 3 reserved in the modification treatment cell 2, thereby building a system in which the workpiece will be surface-modified (a surface modification treatment system). The surface modification treatment for the workpiece (the cathode electrode 5) takes place on the portion immersed in the electrolytic solution 3.

Next, a voltage V that is not less than a predetermined first voltage $V_1$ and less than a predetermined second voltage $V_2$ ($0<V_1 \leq V<V_2$) is applied between the anode electrode 4 and the cathode electrode 5, thereby modifying the surface of the workpiece (the cathode electrode 5) (surface modification treatment step).

Here, the first voltage $V_1$ can be determined from voltage-current characteristics of the surface modification treatment system that are measured beforehand. In detail, the first voltage $V_1$ corresponds to a current value $I_{HALF}$ that is ½ of the sum of a first maximum current value $I_{MAX}$ and a first minimum current value $I_{MIN}$ ($=(I_{MAX}+I_{MIN})/2$) in the measurement of voltage-current characteristics of the surface modification treatment system wherein the first maximum current value is a maximum value that is reached first by a current I which is being gradually increased by raising the applied voltage V (a maximum value of current I that appears first in a positive voltage region V>0) and the first minimum current value is a minimum value reached before the current I that has reached the first maximum current value $I_{MAX}$ and thereafter been gradually decreased starts to be increased again (a minimum value that appears first in the positive voltage region) or a value at which the current I stays constant without being increased.

Figure 2:
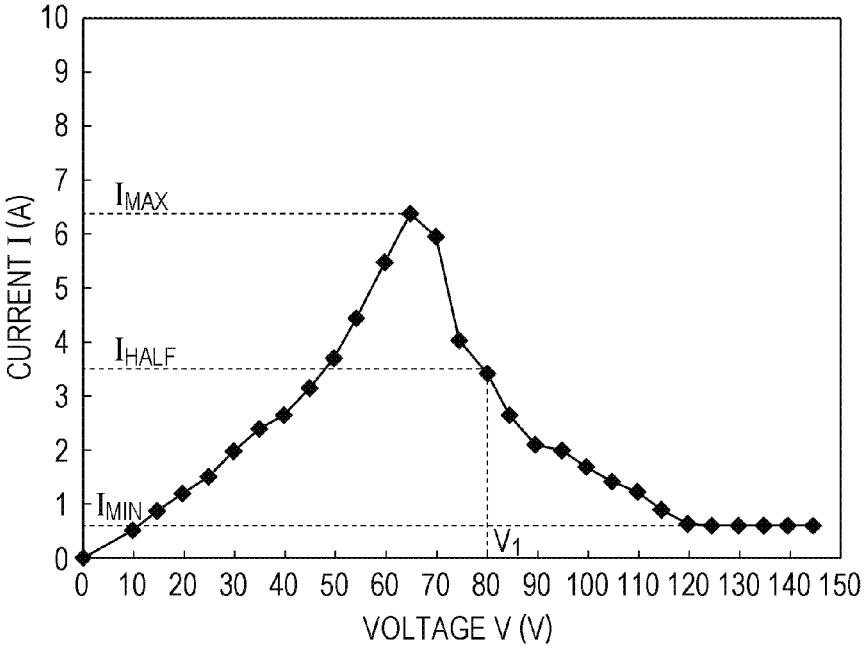
FIG. 2 is a graph showing voltage-current characteristics of a surface modification treatment system in which the workpiece is a cold-rolled steel sheet.
Figure 3:
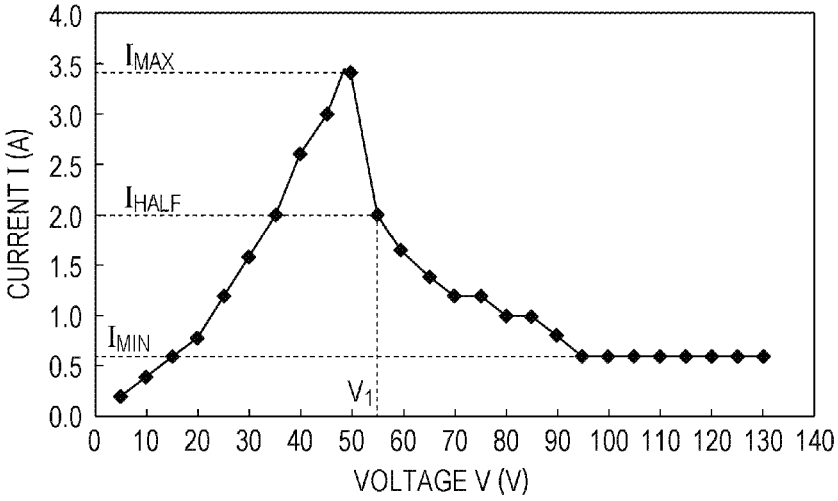
FIG. 3 is a set of graphs showing voltage-current characteristics of a surface modification treatment system in which the workpiece is a stainless steel, wherein (a) shows voltage-current characteristics for stainless steel SUS 316L and (b) shows voltage-current characteristics for stainless steel SUS 430.
Figure 3:
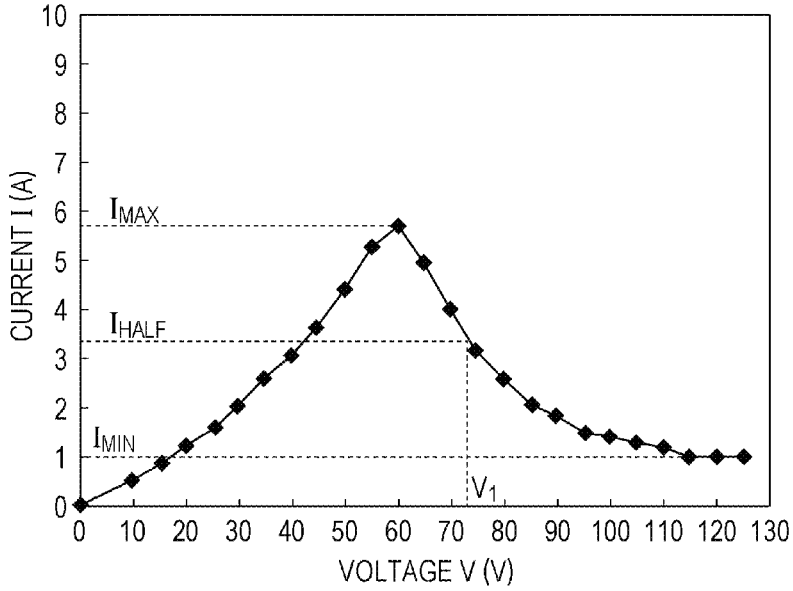
Figure 4:
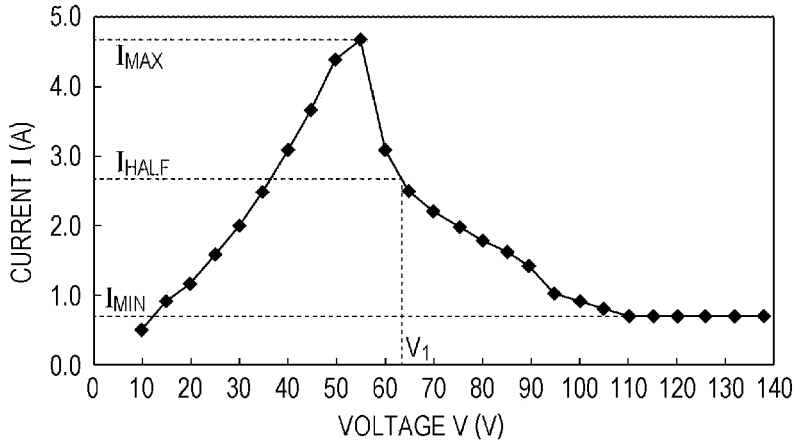
FIG. 4 is a set of graphs showing voltage-current characteristics of a surface modification treatment system in which the workpiece is a metal (nickel), wherein (a) shows voltage-current characteristics for a nickel being a nickel sheet and (b) shows voltage-current characteristics for a nickel being a nickel wire.
Figure 4:
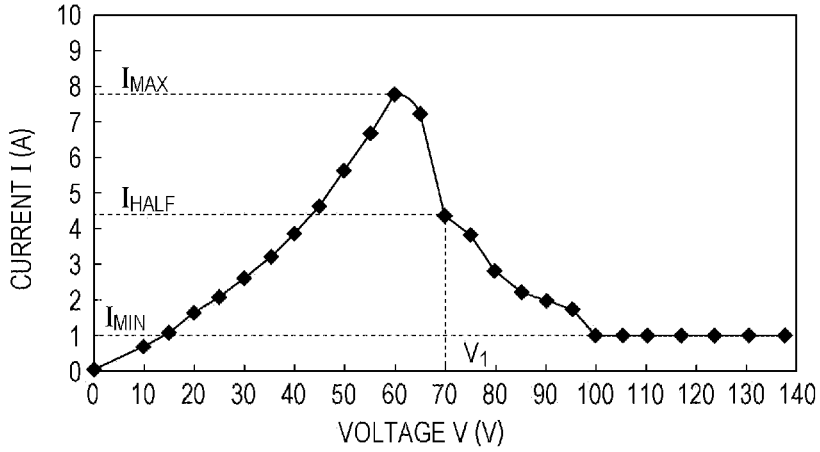

In more detail, the first voltage $V_1$ will be described with reference to FIGS. 2 to 4, which illustrate voltage-current characteristics of surface modification treatment systems for various workpieces. For example, the first voltage $V_1$ may be determined from voltage-current characteristics in accordance with the following procedures (1) to (3). FIG. 2 shows voltage-current characteristics of a surface modification treatment system in which the workpiece is a cold-rolled steel sheet. FIGS. 3(*a*) and (*b*) show voltage-current characteristics of a surface modification treatment system in which the workpiece is a stainless steel. FIG. 4 shows voltage-current characteristics of a surface modification treatment system in which the workpiece is a nickel material.

(1) First, changes in current are measured while altering the voltage applied to the surface modification treatment system, thereby obtaining voltage-current characteristics. The voltage-current characteristics of the surface modification treatment system show that when the applied voltage V is increased, the magnitude of current I is increased so as to reach a maximum value and then decreased, and is thereafter increased again or stays constant without being increased.

(2) Next, the first maximum current value $I_{MAX}$ is obtained from the voltage-current characteristics by determining a maximum value that is reached first by the current I being gradually increased. Further, the first minimum current value $I_{MIN}$ is obtained by determining a minimum value reached before the current I that has reached the first maximum current value $I_{MAX}$ and thereafter been gradually decreased starts to be increased again (a minimum value that appears first in the positive voltage region) or by determining a value at which the current I stays constant without being increased.

(3) Lastly, a current value $I_{HALF}$ is calculated which is ½ of the sum of the first maximum current value $I_{MAX}$ and the first minimum current value $I_{MIN}$ ($=(I_{MAX}=I_{MIN})/2$), thereby determining the first voltage $V_1$ that gives the current value $I_{HALF}$ in the voltage-current characteristics.

The second voltage $V_2$ is a voltage which causes the surface modification treatment system to show a complete-state plasma. For example, the second voltage $V_2$ may be obtained by repeatedly applying a voltage to the surface modification treatment system for 30 minutes while increasing the voltage stepwise by 5 V or 10 V and experimentally determining the voltage at which a superficial layer of the cathode electrode is oxidized with a thickness of at least 100 nm.

Here, the magnitudes of the first voltage $V_1$ and the second voltage $V_2$ vary depending on the surface modification treatment systems. For example, the magnitude of the first voltage $V_1$ is frequently not less than 60 V and the magnitude of the second voltage $V_2$ is frequently not more than 140 V. In detail, the first voltage $V_1$ is 80 V and the second voltage $V_2$ is 140 V when the conductive material is a carbon steel. The first voltage $V_1$ is 55 V and the second voltage $V_2$ is 125 V when the conductive material is a stainless steel (SUS 316L).

Figure 5:
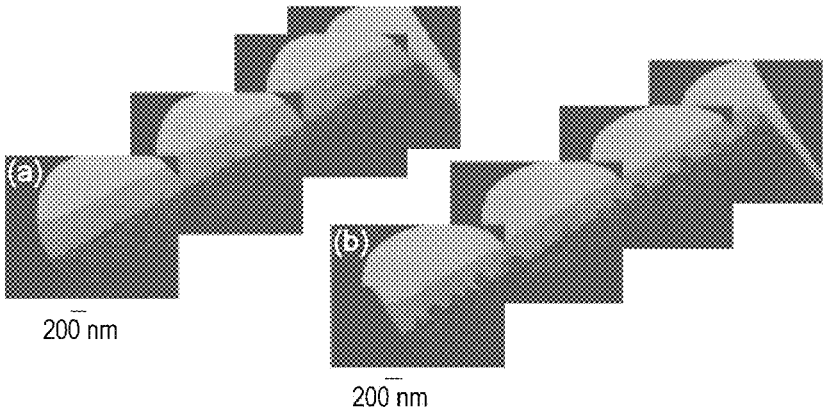
FIG. 5 is a set of transmission electron microscopy (TEM) images that show cross sectional shapes of a fine structure on a surface-modified stainless steel (SUS 316L) produced by a method according to the present invention, wherein (a) shows a cross section of the surface modified by the treatment with the voltage of 90 V and (b) shows a cross section of the surface modified by the treatment with the voltage of 100 V.

When a voltage V that is not less than the first voltage $V_1$ and is less than the second voltage $V_2$ is applied between the anode electrode 4 and the cathode electrode 5 as described hereinabove, a large number of fine protrusions with nanometer-sized height and diameter, preferably not more than 500 nm, such as those illustrated in FIG. 5, are formed on the surface (the work surface) of the cathode electrode 5 that is the workpiece. That is, the work surface is modified by the formation of a nano-level fine structure on the work surface.

Although not clear in principle, such fine protrusions are probably formed by submerged plasma discharge taking place locally in the vicinity of the cathode electrode 5. According to the inventive method for producing electrically-conducting materials with modified surface, if the energizing voltage between the anode electrode 4 and the cathode electrode 5 is less than the first voltage $V_1$, the sufficient local submerged plasma discharge is not induced, resulting in a failure to form fine protrusions (a fine structure). If the applied voltage is equal to or higher than the second voltage $V_2$, the cathode electrode 5 that is the workpiece is oxidized by the generation of complete-state plasma, resulting in the work surface with a roughness of several μm and a consequent failure to form fine protrusions (a fine structure).

Here, submerged plasma discharge is considered to occur by a mechanism in which the application of a voltage locally brings the temperature of the electrolytic solution in the vicinity of the cathode electrode 5 to or above the boiling point so as to generate a gas phase near the cathode electrode 5 in which a plasma discharge takes place. Thus, it is preferable that in the surface modification treatment step, a voltage be applied between the anode electrode 4 and the cathode electrode 5 after the temperature of the electrolytic solution is adjusted to be in the range of 85° C. to 100° C. Such a configuration is preferable because the temperature in the vicinity of the cathode electrode 5 can be efficiently increased to allow submerged plasma discharge to take place efficiently. In the surface modification treatment step, the voltage application time may be any duration, for example not less than 5 seconds and not more than 30 minutes. By the way, the size of fine protrusions formed becomes smaller as the voltage application time is shorter. Thus, the voltage application time may be selected appropriately in accordance with desired surface shapes or characteristics.

As mentioned above, the inventive method for producing electrically-conducting materials with modified surface enables low-cost and efficient production of conductive materials on the surface of which a nano-level fine structure is formed, without entailing any expensive devices or advanced techniques but by simply controlling the voltage applied between the anode electrode and the cathode electrode immersed in the electrolytic solution. By the way, conductive materials with a nano-level fine structure formed on the surface can exhibit various functions enabled by the fine structure.

The inventive method for producing electrically-conducting materials with modified surface is not limited to the above-described embodiment. Appropriate changes are possible for the method for producing surface-modified conductive materials of the present invention.

Hereinbelow, the present invention will be described in greater detail by EXAMPLES 1 to 3. However, the scope of the invention is not limited to EXAMPLES 1 to 3.

EXAMPLE 1

With the use of a device illustrated in FIG. 1, a commercial cold-rolled steel sheet (a mild steel sheet containing C at 0.018 mass %, Si at 0.01 mass % and Mn at 0.14 mass: width 3 mm, length 20 mm, thickness 0.7 mm) as a workpiece was subjected to a surface modification treatment at various voltages.

In detail, the first voltage $V_1$ was measured by determining voltage-current characteristics of a surface modification treatment system in which an anode electrode was a platinum electrode, a cathode electrode was the above commercial cold-rolled steel sheet that had been cleaned with diluted hydrochloric acid, and an electrolytic solution was a 0.1 mol/L aqueous potassium carbonate solution that had been heated to a temperature of 92 to 97° C. beforehand. Further, a voltage which caused the surface modification treatment system to show a complete-state plasma (the second voltage $V_2$) was determined. Here, the electrodes were immersed in the electrolytic solution over a length of 20 mm, and the upper portions which almost touched the liquid surface of the electrolytic solution were covered with a heat resistant resin.

As a result, voltage-current characteristics shown in FIG. 2 were obtained. This surface modification treatment system which involved the commercial cold-rolled steel sheet as the workpiece was shown to have a first maximum current value $I_{MAX}$ of 6.3 A, a first minimum current value $I_{MIN}$ of 0.7 A, $I_{HALF}$ (=$(I_{MAX}+I_{MIN})/2$) of 3.5 A, and a first voltage $V_1$ of 80 A. The second voltage $V_2$ was found to be 140 V.

Next, a surface modification treatment system similar to that used for the measurement of voltage-current characteristics was provided to perform a surface modification treatment for the workpiece by applying a voltage described in Table 1 between the anode electrode and the cathode electrode for 30 minutes, thereby preparing a surface-modified cold-rolled steel sheet. Several surface-modified cold-rolled steel sheets were fabricated by changing the magnitude of the applied voltage in the range of 75 V to 145 V. The surface of the surface-modified cold-rolled steel sheets (cathode electrodes) was observed with a scanning electron microscope (SEM). When a nanometer-sized fine structure (fine protrusions) was found to have been formed on the surface, the size of the fine protrusions (the average diameter of the fine protrusions regarded as circles in a plan view) was measured. The results are described in Table 1.

TABLE 1

| No. | Workpiece | Applied voltage [V] | Formation of fine protrusions | Size of fine protrusions [nm] | Remarks |
|---|---|---|---|---|---|
| PROD. EX. 1 | Cold-rolled steel sheet | 75 | No | — | COMP. EX. |
| PROD. EX. 2 | Cold-rolled steel sheet | 80 | Yes | 50 | INV. EX. |
| PROD. EX. 3 | Cold-rolled steel sheet | 100 | Yes | 150 | INV. EX. |
| PROD. EX. 4 | Cold-rolled steel sheet | 115 | Yes | 300 | INV. EX. |
| PROD. EX. 5 | Cold-rolled steel sheet | 135 | Yes | 800 | INV. EX. |
| PROD. EX. 6 | Cold-rolled steel sheet | 145 | No (Surface was oxidized.) | — | COMP. EX. |

Figure 6:
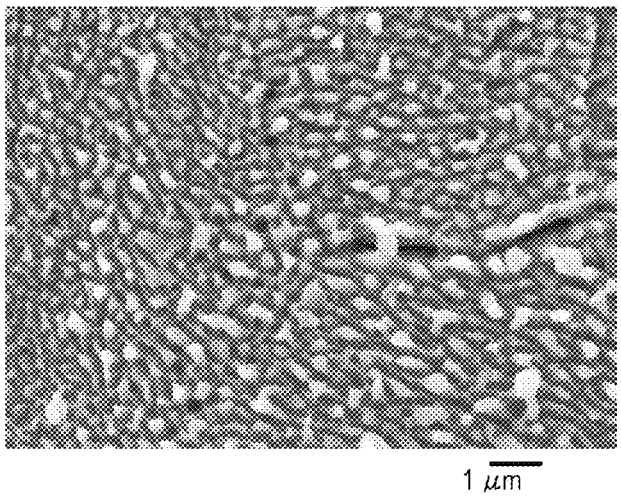
FIG. 6 is a SEM image that shows a surface condition of a surface-modified cold-rolled steel sheet produced by a method according to the present invention.

From Table 1, it has been shown that surface modification at an applied voltage of 80 to 135 V realized low-cost and efficient formation of a nanometer-sized fine structure on the work surface. In PRODUCTION EXAMPLE 1 in which the applied voltage was 75 V (less than the first voltage $V_1$), distinct fine protrusions were not formed. PRODUCTION EXAMPLE 6 which involved an applied voltage of 145 V (not less than the second voltage $V_2$) resulted in local oxidation of the surface of the cathode electrode (the workpiece) and a consequent failure to form fine protrusions. A SEM image showing a surface condition of the surface-modified cold-rolled steel sheet fabricated in PRODUCTION EXAMPLE 4 is shown in FIG. 6.

EXAMPLE 2

With the use of a device illustrated in FIG. 1, various workpieces (ferrite stainless steel SUS 430 (width 2 mm, length 20 mm), nickel sheets (width 2 mm, length 20 mm), nickel wires (diameter 1 mm, length 40 mm)) were subjected to a surface modification treatment.

In detail, the first voltage $V_1$ was measured by determining respective voltage-current characteristics of a surface modification treatment system in which an anode electrode was a platinum electrode, a cathode electrode was any of the above workpieces, and an electrolytic solution was a 0.1 mol/L aqueous potassium carbonate solution that had been heated to a temperature of 92 to 97° C. beforehand. Further, a voltage which caused each surface modification treatment system to show a complete-state plasma (the second voltage $V_2$) was determined. Here, the electrodes were immersed in the electrolytic solution over a length of 20 mm, and the surface of the electrolytic solution was covered with a heat resistant resin. FIG. 3(*b*) shows voltage-current characteristics for SUS 430 as the workpiece. FIG. 4(*a*) shows voltage-current characteristics for the nickel sheet as the workpiece. FIG. 4(*b*) shows voltage-current characteristics for the nickel wire as the workpiece.

From FIG. 3(*b*) and FIGS. 4(*a*) and (*b*), it has been shown that the system with the SUS 430 workpiece had a first voltage $V_1$ of 73 V and a second voltage $V_2$ of 125 V, the system with the nickel sheet workpiece had a first voltage $V_1$ of 63 V and a second voltage $V_2$ of 130 V, and the system with the nickel wire workpiece had a first voltage $V_1$ of 70 V and a second voltage $V_2$ of 135 V.

Figure 7:
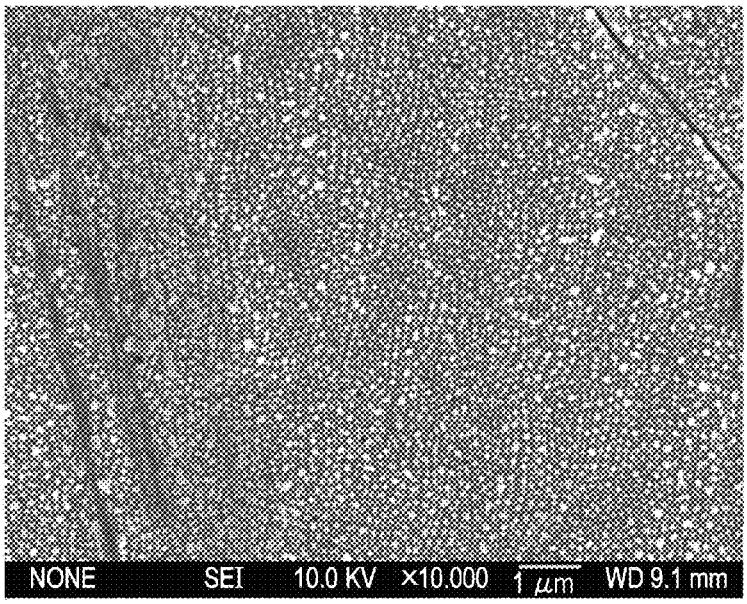
FIG. 7 is a SEM image that shows a surface condition of a surface-modified nickel material (nickel sheet) produced by a method according to the present invention.

Thereafter, each workpiece was surface-modified by applying a voltage that was not less than the first voltage and less than the second voltage, thereby forming nanometer-sized fine protrusions on the work surface. As an example, FIG. 7 shows a SEM image of the surface of the nickel sheet treated at an applied voltage of 100 V for 30 minutes.

EXAMPLE 3

With the use of a device illustrated in FIG. 1, SUS 316L (wire rods that had been rolled to a width of 1.5 mm, a length of 40 mm and a thickness of 0.2 mm) as the workpiece was subjected to a surface modification treatment.

In detail, the first voltage $V_1$ was measured by determining voltage-current characteristics of a surface modification treatment system in which an anode electrode was a platinum mesh electrode, a cathode electrode was the above SUS 316L that had been specular polished on the surface with No. 4000 sand paper, and an electrolytic solution was a 0.1 mol/L aqueous potassium carbonate solution that had been heated to a temperature of 95° C. beforehand. Further, a voltage which caused the surface modification treatment system to show a complete-state plasma (the second voltage $V_2$) was determined. Here, the electrodes were immersed in the electrolytic solution over a length of 20 mm.

As a result, voltage-current characteristics shown in FIG. 3(*a*) were obtained. This surface modification treatment system which involved SUS 316L as the workpiece was shown to have a first maximum current value $I_{MAX}$ of 3.4 A, a first minimum current value $I_{MIN}$ of 0.6 A, $I_{HALF}$ (=($I_{MAX}$+$I_{MIN}$)/2) of 2.0 A, and a first voltage $V_1$ of 55 V. The second voltage $V_2$ was found to be 125 V.

Next, a surface modification treatment system similar to that used for the measurement of voltage-current characteristics was provided to perform a surface modification treatment for the workpiece by applying a voltage described in Table 2 between the anode electrode and the cathode electrode for a duration of time described in Table 2, thereby preparing surface-modified SUS 316L. Surface properties of the surface-modified SUS 316L were evaluated as described below.

TABLE 2

| No. | Workpiece | Applied voltage [V] | Application time [min] | Remarks |
|---|---|---|---|---|
| PROD. EX. 7 | SUS 316L | 90 | 30 | INV. EX. |
| PROD. EX. 8 | SUS 316L | 100 | 30 | INV. EX. |

<Evaluation of Surface Properties>

The fine structures on the surface of the surface-modified SUS 316L fabricated in PRODUCTION EXAMPLES 7 and 8 were observed with SEM and TEM. FIG. 5(*a*) shows a TEM image of the fine structure of the surface-modified SUS 316L in PRODUCTION EXAMPLE 7. FIG. 5(*b*) and FIG. 8 show a TEM image and a SEM image, respectively, of the fine structure of the surface-modified SUS 316L in PRODUCTION EXAMPLE 8.

Figure 8:
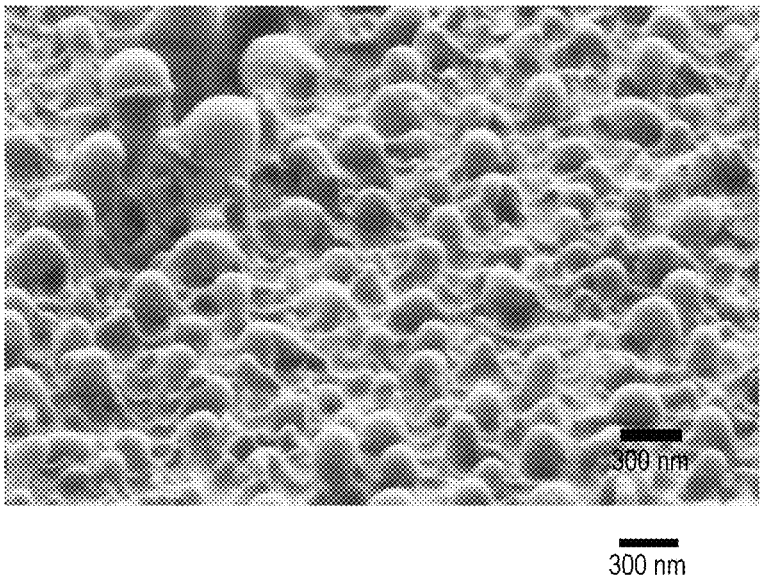
FIG. 8 is a SEM image that shows a shape of a fine structure on a surface-modified stainless steel (SUS 316L) produced by a method according to the present invention.

As shown in FIGS. 5 and 8, a large number of fine protrusions with sizes of about several tens of nanometers to several hundreds of nanometers were formed on the surface. Many of these fine protrusions had a mushroom-like shape being thinner at a lower portion than near the top end. The size of fine protrusions can be controlled by changing the applied voltage. The fine protrusions had a size of not more than 100 nm in PRODUCTION EXAMPLE 7 in which the applied voltage was 90 V, and had a size of about 200 to 300 nm in PRODUCTION EXAMPLE 8 in which the applied voltage was 100 V. Further, it is assumed that the density (population density) of fine protrusions could be controlled by changing the applied voltage. The number density of fine protrusions was lower in PRODUCTION EXAMPLE 8 (about 32 protrusions/$\mu m^2$) with an applied voltage of 100 V than in PRODUCTION EXAMPLE 7 (about 7 protrusions/$\mu m^2$) with an applied voltage of 90 V.

Figure 9:
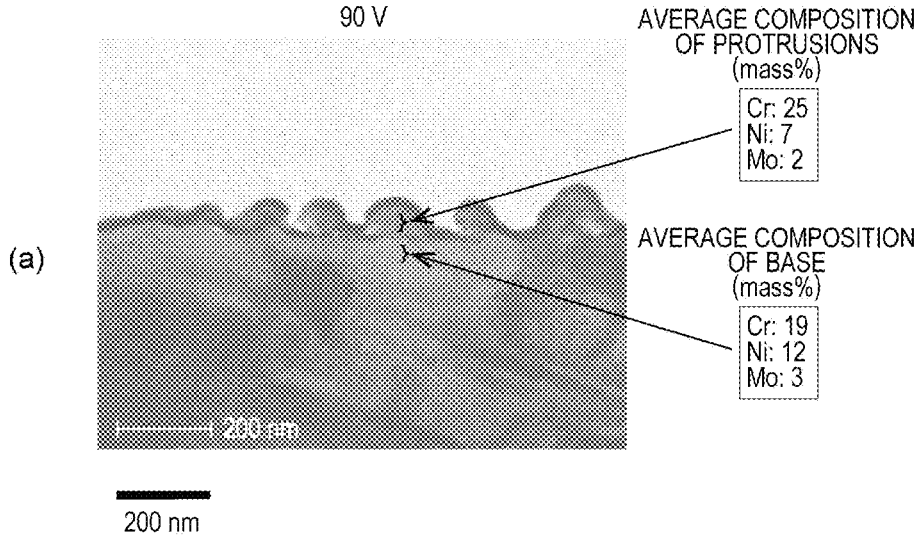
FIG. 9 is a set of transmission electron microscopy (TEM) images that show in cross sectional view compositions of a fine structure on a surface-modified stainless steel (SUS 316L) produced by a method according to the present invention, wherein (a) shows an embodiment in which the surface modification treatment system was energized at 90 V and (b) shows an embodiment in which the surface modification treatment system was energized at 100 V.
Figure 9:
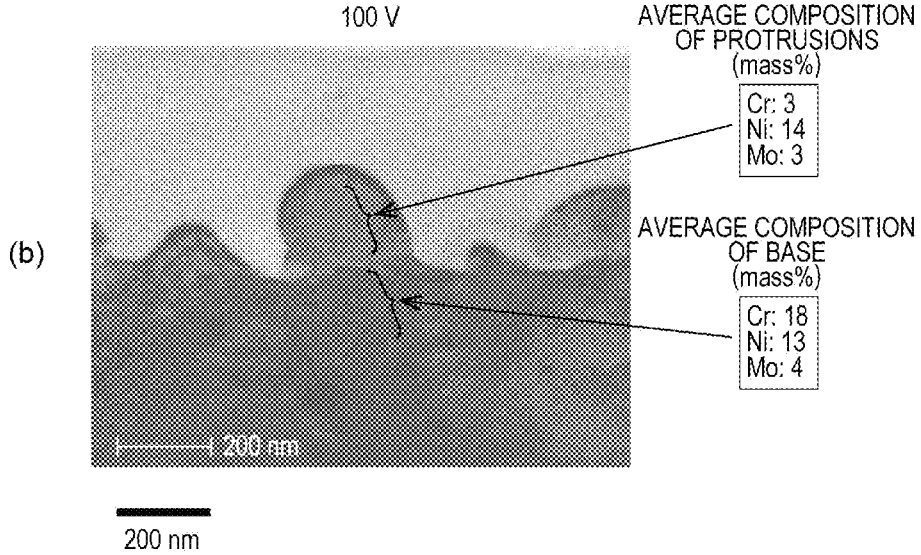

When the surface of the surface-modified SUS 316L fabricated in PRODUCTION EXAMPLES 7 and 8 was observed with a transmission electron microscope (TEM), elemental analysis was performed with an energy dispersive X-ray spectrometer (EDS) attached to TEM. FIG. 9(*a*) shows a TEM image and the results of elemental analysis in PRODUCTION EXAMPLE 7, and FIG. 9(*b*) shows a TEM image and the results of elemental analysis in PRODUCTION EXAMPLE 8. The results of elemental analysis in FIG. 9 indicate an average composition (quantitatively determined with respect to metal elements alone, unit: mass %) of the fine protrusions and that of the base portion. For reference, the composition of SUS 316L before the surface modification was in the range of Ni: 12 to 15%, Cr: 16 to 18% and Mo: 2 to 3% in terms of mass %.

From FIG. 9, the surface-modified SUS 316L fabricated in PRODUCTION EXAMPLE 7 has been shown to h ave a higher Cr concentration in the fine protrusions than in the base portion and a lower Ni concentration in the fine protrusions than in the base portion. On the other hand, the surface-modified SUS 316L fabricated in PRODUCTION EXAMPLE 8 has been shown to have a markedly lower Cr concentration in the fine protrusions than in the base portion. Thus, these results indicate that the inventive production method has a possibility for producing conductive materials that have fine protrusions with a controlled composition. Accordingly, the inventive production method has applicability for the production of highly anticorrosive surfaces with Cr enrichment or for the production of Cr-deficient catalytic surfaces with Ni functioning as an effective element.

EXAMPLE 4

Figure 10:
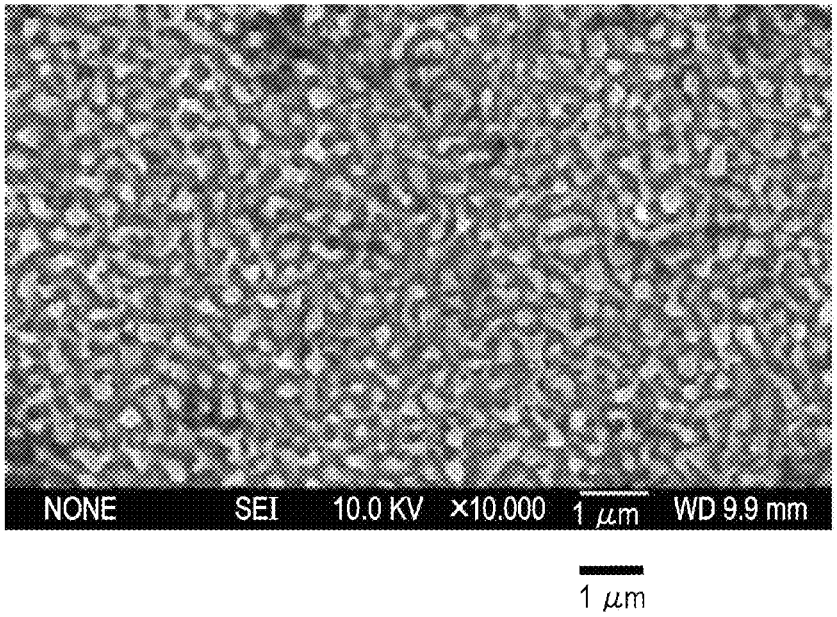
FIG. 10 is a SEM image that shows a surface condition of a surface-modified stainless steel (SUS 316) produced by a method according to the present invention.

A surface modification treatment system was provided in which an anode electrode was a platinum electrode, a cathode electrode was surface-polished SUS 316(length 20 mm, thickness 0.8 mm, width 2 mm), and an electrolytic solution was a 0.1 mol/L $K_2CO_3$ solution. By applying a voltage for 15 minutes while changing the magnitude of voltage in the range of 90 V to 120 V, fine protrusions of various sizes and distributions were formed on the surface of the cathode electrodes. An example of the SEM images showing the surface of SUS 316is given in FIG. 10. The above surface modification treatment system with SUS 316as the cathode electrode had a first voltage $V_1$ of 78 V and a second voltage $V_2$ of 125 V.

Water repellency and emission characteristics of the surface of the surface-modified SUS 316were evaluated as described below.

<Evaluation of Water Repellency of Surface>

With respect to the surface-modified SUS 316, water droplets were dropped onto the surface and the ratio of the height of the water droplet to the width (the diameter) of the water droplet in contact with the surface was measured. The largest height/contact width ratio was 0.62. The height/contact width ratio was 0.38 for the surface of SUS 316before the surface modification. These results confirmed that the surface-modified SUS 316achieved improved water repellency. Thus, it is assumed that the surface-modified SUS 316has attained a highly anticorrosive surface with high repellency against water droplets.

Figure 11:
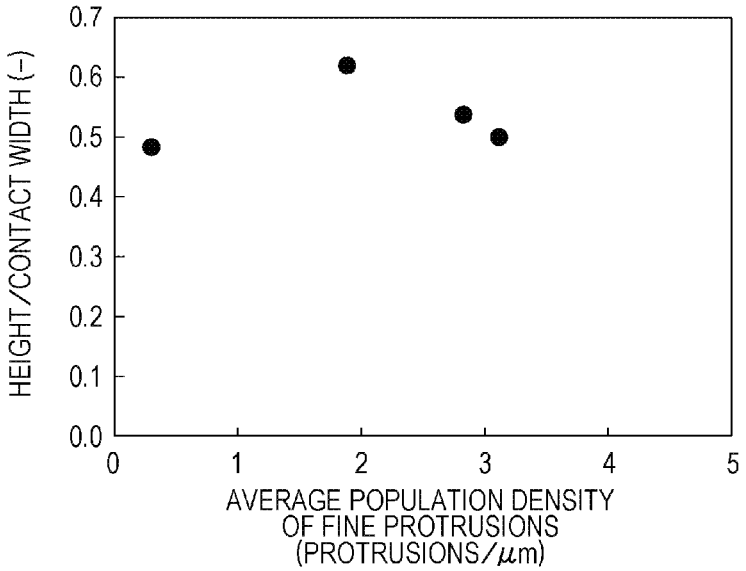
FIG. 11 is a graph that shows a relationship between the average population density of fine protrusions present on the surface of stainless steel and the ratio of the height to the contact width of water droplets dropped onto the surface (height/contact width), with respect to a surface-modified stainless steel (SUS 316) produced by a method according to the present invention.

With respect to the surface-modified SUS 316, a relationship was examined between the average number of fine protrusions per 1 μm (the average population density of fine protrusions: protrusions/μm) and the height/contact width ratio of water droplets, the results being shown in FIG. 11. It has been then found that a surface with a lower average population density of fine protrusions (namely, the number of fine protrusions was small and the fine protrusions were large) tended to exhibit higher water repellency than a surface with a higher average population density of fine protrusions (namely, the number of fine protrusions was large and the size of fine protrusions was small), except when the fine protrusions had a markedly low average population density (namely, the number of fine protrusions was markedly small and the size of fine protrusions was markedly large). Thus, it has been found preferable that fine protrusions be formed at a relatively high voltage, for example 100 V or higher, from the viewpoint of increasing water repellency.

The average population density of fine protrusions was determined by drawing a 3 μm straight line on the SEM image of the surface, counting the number of fine protrusions across which the straight line ran with respect to arbitrary selected 10 points, and calculating the average per 1 μm length.

<Evaluation of Emission Characteristics of Surface>

Figure 12:
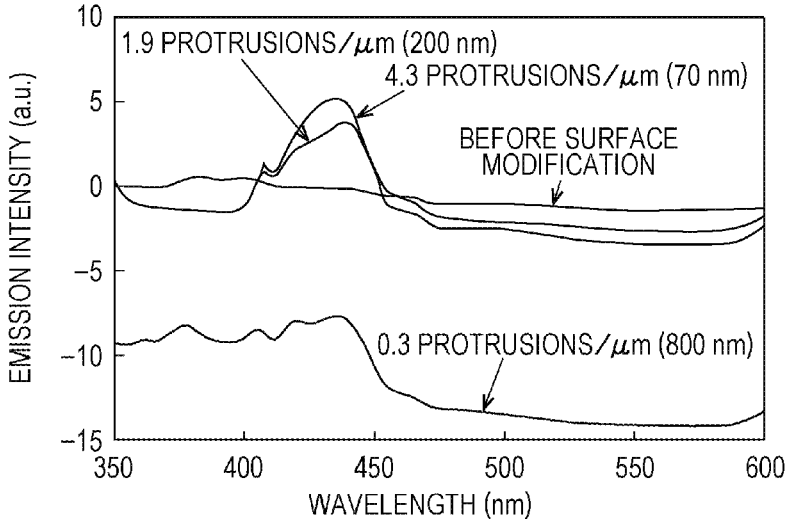
FIG. 12 shows photoluminescence spectra of the surfaces of surface-modified stainless steels (SUS 316) produced by a method according to the present invention.

Emission characteristics of the surface of the surface-modified SUS 316were evaluated by photoluminescence measurement. The obtained photoluminescence spectra of the surfaces are shown in FIG. 12. FIG. 12 shows emission characteristics of the SUS 316surface having an average population density of fine protrusions of 4.3 protrusions/μm, 1.9 protrusions/μm or 0.3 protrusions/μm, as well as emission characteristics of the SUS 316surface before the surface modification. In the figure, the numbers in parenthesis indicate the average diameters of the formed fine protrusions.

From FIG. 12, it has been found that the surface-modified SUS 316shows a distinct emission intensity peak in a visible light region in the vicinity of 400 nm to 470 nm wavelengths that is not observed with (polished) SUS 316before the surface modification. Based on this result, it is assumed that the surface of the surface-modified SUS 316could be used in applications such as light-emitting devices.

Figure 13:
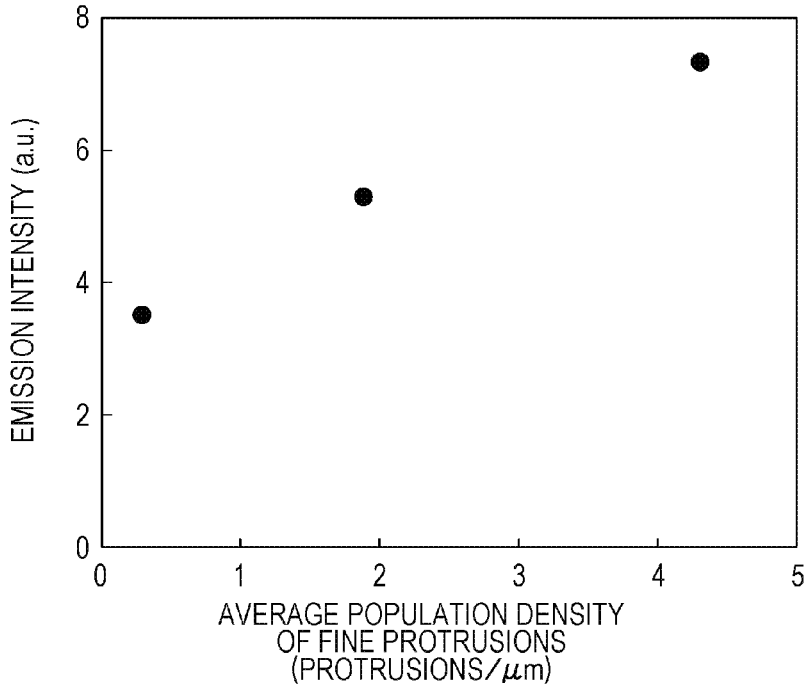
FIG. 13 is a graph that shows a relationship between the average population density of fine protrusions present on the surface of stainless steel and the emission intensity near 440 nm wavelength, with respect to a surface-modified stainless steel (SUS 316) produced by a method according to the present invention.

With respect to the surface-modified SUS 316, a relationship was examined between the average number of fine protrusions per 1 μm (the average population density of fine protrusions: protrusions/μm) and the net emission intensity (arbitrary unit) of the emission peak at near 440 nm wavelength, the results being shown in FIG. 13. The net emission intensity is the height from the background to the peak top wherein the background is a straight line connecting a point at 390 nm wavelength and a point at 490 nm wavelength. The average population density of fine protrusions was determined in the same manner as described in the evaluation of water repellency.

From FIG. 13, the surface-modified SUS 316has been shown to have higher emission characteristics than (polished) SUS 316before the surface modification (the net emission intensity was substantially 0). Further, it has been found that the net emission intensity was higher with increasing average population density of fine protrusions (namely, as the number of fine protrusions was larger and the size of fine protrusions was smaller). Thus, it is preferable from the viewpoint of improving emission characteristics that finer protrusions be formed at a lower voltage.

INDUSTRIAL APPLICABILITY

According to the present invention, conductive materials on the surface of which a nano-level fine structure is formed can be produced at low cost and efficiently.

REFERENCE SIGNS LIST

1 SURFACE MODIFICATION DEVICE
2 MODIFICATION TREATMENT CELL
3 ELECTROLYTIC SOLUTION
4 ANODE ELECTRODE
5 CATHODE ELECTRODE
6 DIRECT-CURRENT POWER SOURCE

The invention claimed is:

1. A method for producing electrically-conducting materials with a modified surface, comprising:

obtaining first and second voltages prior to a surface modification treatment in a first surface modification treatment system, wherein the first voltage is a voltage corresponding to a current value that is ½ of the sum of a first maximum current value that appears first in a positive voltage region and a first minimum current value that appears first in the positive voltage region with respect to voltage-current characteristics of a surface modification treatment system which corresponds to the first surface modification treatment system in which the surface modification treatment is carried out, wherein the second voltage is a voltage that exhibits a complete-state plasma in a surface modification treatment system which corresponds to the first surface modification treatment system in which the surface modification treatment is carried out;

in the first surface modification treatment system, carrying out the surface modification treatment comprising:

immersing a stable anode electrode and a workpiece as a cathode electrode in an electrolytic solution, the workpiece including a conductive material with a work surface and the electrolytic solution having a higher ionization tendency than the workpiece, thereafter applying a voltage that is not less than the first voltage, which was obtained prior to execution of the surface modification treatment, and less than the second voltage, which was also obtained prior to execution of the surface modification treatment, between the stable anode electrode and the workpiece as the cathode electrode immersed in the electrolytic solution, thereby modifying the work surface, and forming a nano-level fine structure on the work surface of the workpiece.

2. The method for producing electrically-conducting materials with modified surface according to claim 1, wherein the applied voltage is not less than 60 V and less than 140 V.

3. The method for producing electrically-conducting materials with modified surface according to claim 1, wherein the conductive material is a metal or an alloy.

4. The method for producing electrically-conducting materials with modified surface according to claim 2, wherein the conductive material is a carbon steel.

5. The method for producing electrically-conducting materials with modified surface according to claim 2, wherein the conductive material is a stainless steels.

6. The method for producing electrically-conducting materials with modified surface according to claim 1, wherein the electrolytic solution is an aqueous solution containing at least one selected from the group consisted of the followings: potassium carbonate, sodium carbonate, sodium hydrogencarbonate and ammonium carbonate, lithium hydroxide, sodium hydroxide, magnesium hydroxide, potassium hydroxide and ammonium hydroxide, sodium chloride, potassium chloride, magnesium chloride and ammonium chloride; sulfates of lithium, sodium, magnesium, potassium and ammonium; nitrates of lithium, sodium, magnesium, potassium and ammonium; citrates of lithium, sodium, magnesium, potassium and ammonium; and sulfuric acid, nitric acid, hydrochloric acid and citric acid.

7. The method for producing electrically-conducting materials with modified surface according to claim 2, wherein the conductive material is a metal or an alloy.

8. The method for producing electrically-conducting materials with modified surface according to claim 2, wherein the electrolytic solution is an aqueous solution containing at least one selected from the group consisted of the followings: potassium carbonate, sodium carbonate, sodium hydrogencarbonate and ammonium carbonate, lithium hydroxide, sodium hydroxide, magnesium hydroxide, potassium hydroxide and ammonium hydroxide, sodium chloride, potassium chloride, magnesium chloride and ammonium chloride; sulfates of lithium, sodium, magnesium, potassium and ammonium; nitrates of lithium, sodium, magnesium, potassium and ammonium; citrates of lithium, sodium, magnesium, potassium and ammonium; and sulfuric acid, nitric acid, hydrochloric acid and citric acid.

9. The method for producing electrically-conducting materials with modified surface according to claim 3, wherein the electrolytic solution is an aqueous solution containing at least one selected from the group consisted of the followings: potassium carbonate, sodium carbonate, sodium hydrogencarbonate and ammonium carbonate, lithium hydroxide, sodium hydroxide, magnesium hydroxide, potassium hydroxide and ammonium hydroxide, sodium chloride, potassium chloride, magnesium chloride and ammonium chloride; sulfates of lithium, sodium, magnesium, potassium and ammonium; nitrates of lithium, sodium, magnesium, potassium and ammonium; citrates of lithium, sodium, magnesium, potassium and ammonium; and sulfuric acid, nitric acid, hydrochloric acid and citric acid.

10. The method for producing electrically-conducting materials with modified surface according to claim 4, wherein the electrolytic solution is an aqueous solution containing at least one selected from the group consisted of the followings: potassium carbonate, sodium carbonate, sodium hydrogencarbonate and ammonium carbonate, lithium hydroxide, sodium hydroxide, magnesium hydroxide, potassium hydroxide and ammonium hydroxide, sodium chloride, potassium chloride, magnesium chloride and ammonium chloride; sulfates of lithium, sodium, magnesium, potassium and ammonium; nitrates of lithium, sodium, magnesium, potassium and ammonium; citrates of lithium, sodium, magnesium, potassium and ammonium; and sulfuric acid, nitric acid, hydrochloric acid and citric acid.

11. The method for producing electrically-conducting materials with modified surface according to claim 5, wherein the electrolytic solution is an aqueous solution containing at least one selected from the group consisted of the followings: potassium carbonate, sodium carbonate, sodium hydrogencarbonate and ammonium carbonate, lithium hydroxide, sodium hydroxide, magnesium hydroxide, potassium hydroxide and ammonium hydroxide, sodium chloride, potassium chloride, magnesium chloride and ammonium chloride; sulfates of lithium, sodium, magnesium, potassium and ammonium; nitrates of lithium, sodium, magnesium, potassium and ammonium; citrates of lithium, sodium, magnesium, potassium and ammonium; and sulfuric acid, nitric acid, hydrochloric acid and citric acid.

12. The method for producing electrically-conducting materials with modified surface according to claim 7, wherein the electrolytic solution is an aqueous solution containing at least one selected from the group consisted of the followings: potassium carbonate, sodium carbonate, sodium hydrogencarbonate and ammonium carbonate, lithium hydroxide, sodium hydroxide, magnesium hydroxide, potassium hydroxide and ammonium hydroxide, sodium chloride, potassium chloride, magnesium chloride and ammonium chloride; sulfates of lithium, sodium, magnesium, potassium and ammonium; nitrates of lithium, sodium, magnesium, potassium and ammonium; citrates of lithium, sodium, magnesium, potassium and ammonium; and sulfuric acid, nitric acid, hydrochloric acid and citric acid.

* * * * *